US009986799B1

(12) United States Patent
King

(10) Patent No.: US 9,986,799 B1
(45) Date of Patent: Jun. 5, 2018

(54) WIND-PROOF DUAL CANOPY SYSTEM

(71) Applicant: Daniel P. King, Chester, NJ (US)

(72) Inventor: Daniel P. King, Chester, NJ (US)

( * ) Notice: Subject to any disclaimer, the term of this patent is extended or adjusted under 35 U.S.C. 154(b) by 0 days. days.

(21) Appl. No.: 15/674,746

(22) Filed: Aug. 11, 2017

(51) Int. Cl.
*A45B 25/22* (2006.01)
*A45B 25/18* (2006.01)

(52) U.S. Cl.
CPC ..... *A45B 25/22* (2013.01); *A45B 25/18* (2013.01); *A45B 2025/186* (2013.01)

(58) Field of Classification Search
CPC .... A45B 25/22; A45B 25/18; A45B 2025/186
USPC ..... 135/15.1, 33.2, 33.7
See application file for complete search history.

(56) References Cited

U.S. PATENT DOCUMENTS 312,446 A * 2/1885 Drake ..... A45B 19/10 135/25.3
617,415 A * 1/1899 Eatman ..... A45B 25/20 135/33.7
1,031,974 A * 7/1912 Thomas ..... A45B 25/22 135/33.7
3,032,047 A * 5/1962 Wendorf ..... A45B 25/22 135/27
3,456,661 A * 7/1969 Farley ..... A45B 25/22 135/33.7
3,863,660 A * 2/1975 Glaeser ..... A45B 25/20 135/115
4,979,534 A * 12/1990 Johnson ..... A45B 25/20 135/33.41
5,289,839 A * 3/1994 Lombardo ..... A45B 25/22 135/16
5,368,055 A 11/1994 Johnson et al.
5,601,103 A * 2/1997 Dubinsky ..... A45B 25/22 135/15.1
5,678,586 A 10/1997 Baksh
6,173,724 B1 * 1/2001 You ..... A45B 25/02 135/15.1
2002/0189656 A1 * 12/2002 David ..... A45B 25/18 135/33.7
2004/0177872 A1 * 9/2004 Guo ..... A45B 25/22 135/33.7
2008/0163910 A1 7/2008 Hollinger

* cited by examiner

*Primary Examiner* — Noah Chandler Hawk
(74) *Attorney, Agent, or Firm* — Thomas J. Germinario

(57) ABSTRACT

A wind-proof dual canopy structure with offset venting in both upper and lower canopies and with inter-canopy suspension structures, keeps the upper and lower vents properly aligned and blocks the perimeter of the lower vents so that rain cannot drip through these vents onto protected persons and/or objects. These inter-canopy suspension structures include elements which are themselves vented, allowing wind that would otherwise get trapped between the canopy layers to escape.

18 Claims, 8 Drawing Sheets

WIND-PROOF DUAL CANOPY SYSTEM

FIELD OF INVENTION

The present invention relates generally to field of canopies, such as tent canopies and umbrella canopies, which are used for protection from precipitation and/or sun. More particularly, the present invention relates to canopies designed to withstand the force of winds.

BACKGROUND OF THE INVENTION

Canopies, typically comprising sheets of impermeable fabric or plastic, are widely used in various applications to shield people and/or objects from precipitation and/or sun. Common applications of such canopies occur in tents and umbrellas.

Unless such canopies are provided with vents, they are apt to be blown away, collapsed or inverted by gusts of wind. The problem with vents, however, is that they allow precipitation as well as wind to pass through the canopy.

Various solutions to this problem have been attempted as applied to umbrella canopies. All of these attempted solutions involve the use of multiple tiered canopies, usually with a smaller upper canopy covering the vent holes around the top of a larger lower canopy. Beach umbrellas, for example, typically incorporate this design. But, because the vented area in the lower canopy must be localized in this design, its effectiveness in withstanding winds from various directions is limited.

Other multi-tier designs adapted to rain umbrellas involve venting in both the upper and lower canopies, with the venting offset so that falling rain cannot pass directly through both layers. But, because the vent holes in the lower canopy are unobstructed, raindrops dripping along the lower canopy can still find their way into these vent holes and drip onto the person holding the umbrella. Also, because these designs lack a structure for maintaining a spaced relation between the upper and lower canopies, wind is apt to get trapped between them, causing disruption and/or damage to the canopies.

SUMMARY OF THE INVENTION

The present invention addresses these as yet unresolved problems by providing a dual canopy structure with offset venting in both upper and lower canopies and with inter-canopy suspension structures, which keep the upper and lower vents properly aligned and block the perimeter of the lower vents, so that rain cannot drip through these vents onto protected persons and/or objects. These inter-canopy suspension structures are comprised of elements which are themselves vented, allowing wind that would otherwise get trapped between the canopy layers to escape.

The present invention comprises a wind-proof dual canopy system, comprising an upper canopy and a lower canopy. Both canopies have a pattern of vent holes, which are uniformly distributed across the entire canopy area from the center to the perimeter. Such widespread distribution of vent holes enables the pattern of vent holes to effectively intercept wind from any direction, including updrafts as well as downdrafts.

The respective patterns of the upper and lower canopy vent holes are configured so that the vent holes of the upper canopy are perpendicularly aligned with unvented sections of the lower canopy, and the vent holes of the lower canopy are perpendicularly aligned with unvented sections of the upper canopy. Maintaining this offset relationship of the upper and lower vent holes are multiple composite suspension structures, each of which comprises a smaller annular inner suspension element that nests within a larger annular outer suspension element.

The inner and outer suspension elements each have a coronal shape, comprising a circlet of tapered projections, similar in shape to a crown or coronet worn by royalty/nobility. As best seen in FIG. 5, the crown-shaped inner suspension element rests upright within the inverted "crown" of the outer suspension element. In this configuration, the annular band of the inner suspension element encloses one of the lower canopy vent holes, while the annular band of the outer suspension element engages and supports an unvented sector of the upper canopy. The arcuate indents between the tapered projections of the two "crowns" are cooperatively configured to provide a path for wind to pass through the composite suspension structure, so that it does not become trapped in the inter-canopy space.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1:
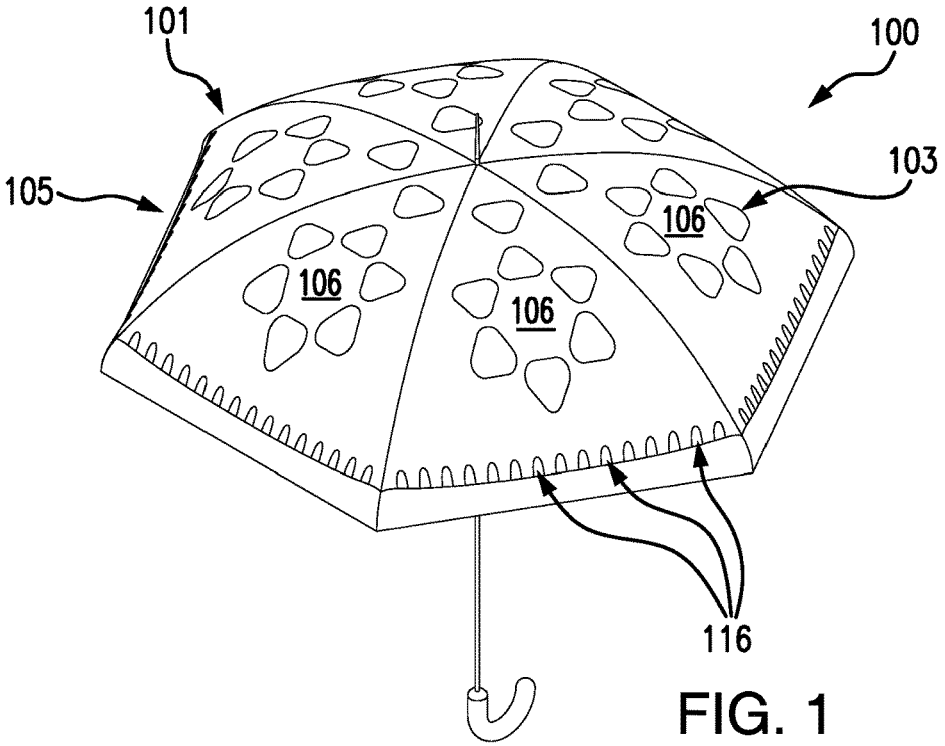
FIG. 1 is a perspective view of a dual umbrella canopy, showing the upper canopy, according to the first embodiment of the present invention.
Figure 2:
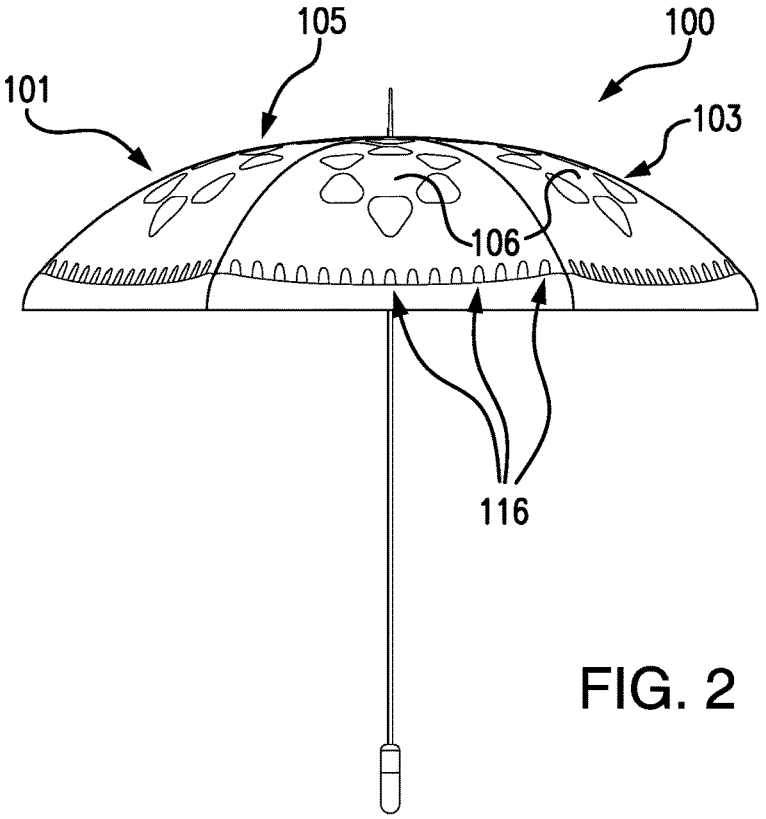
FIG. 2 is a side profile view of the dual umbrella canopy, showing the upper canopy, according to the first embodiment of the present invention.

Referring to FIGS. 1-8, an exemplary wind-proof dual umbrella canopy system, according to the first embodiment of the present invention 100, comprises an upper canopy 101 and a lower canopy 102. The upper canopy has multiple vent holes 103 uniformly distributed across its surface, and the lower canopy also has multiple vent holes 104, which are configured so as not to align perpendicularly with the upper canopy vent holes 103.

Figure 3:
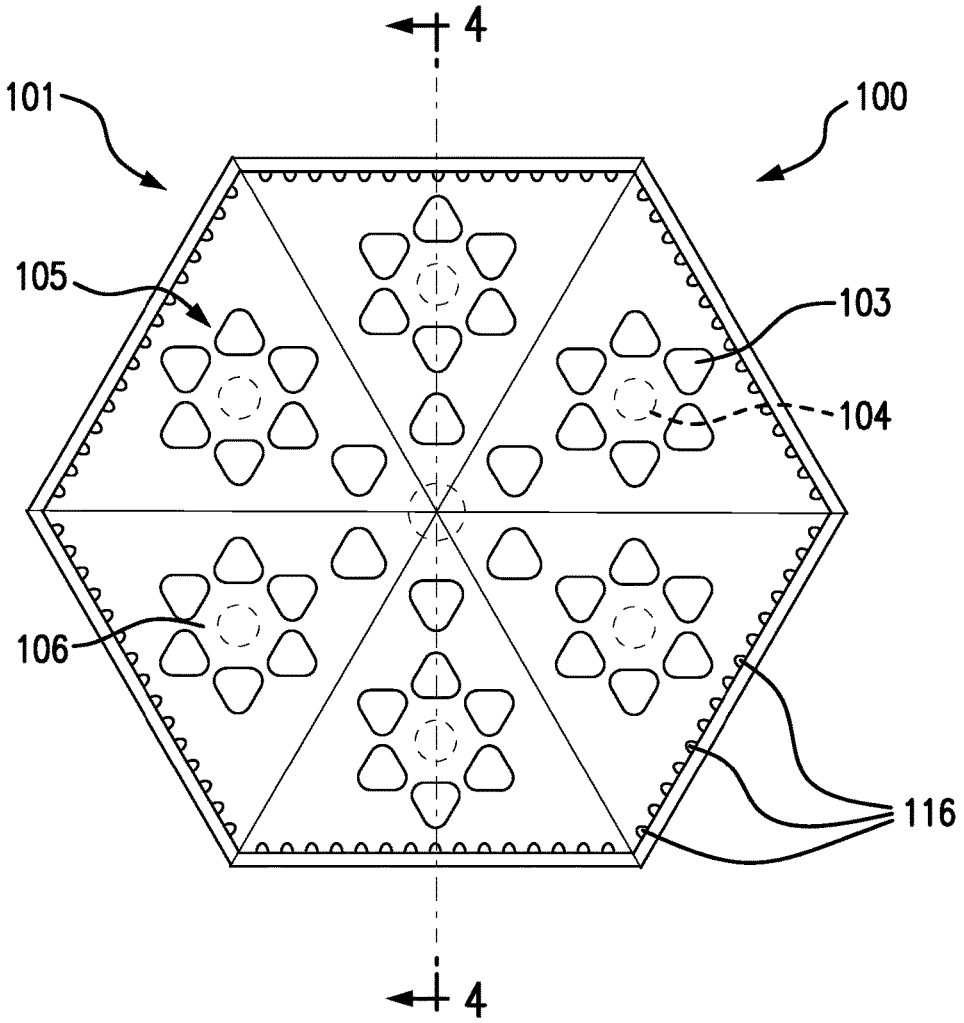
FIG. 3 is a top plan view of the dual umbrella canopy, showing the upper canopy with the lower canopy vent holes ghosted, according to the first embodiment of the present invention.
Figure 7:
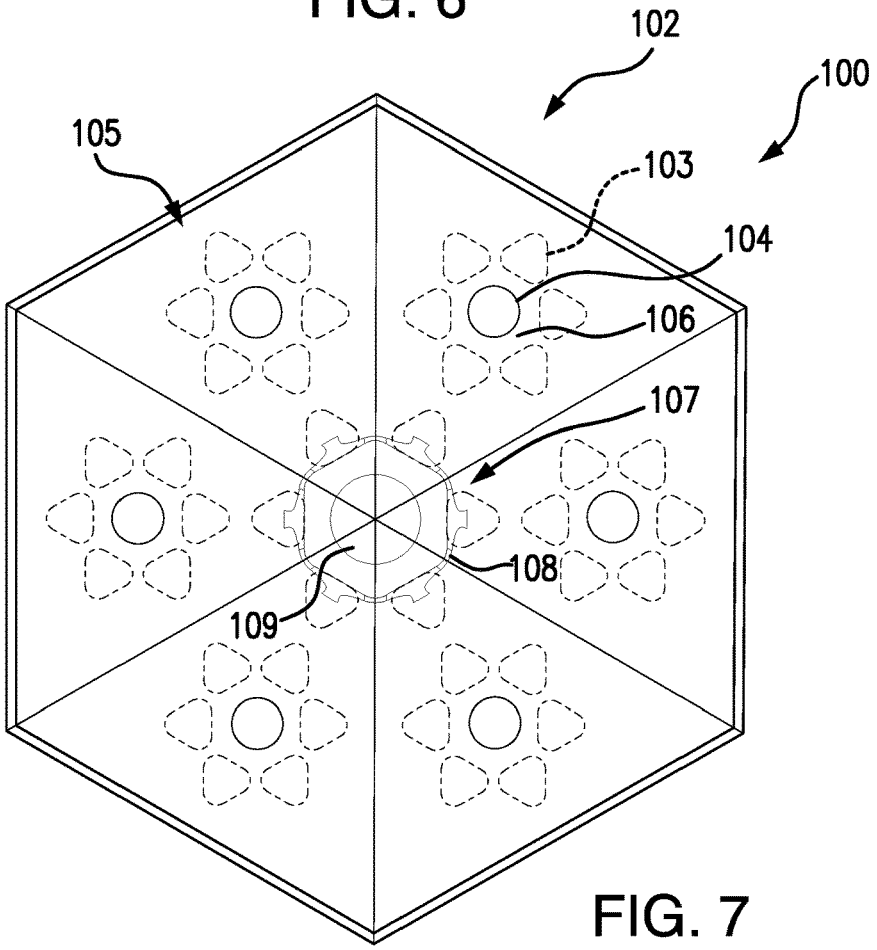
FIG. 7 is a top plan cut-away view of the dual umbrella canopy, showing the lower canopy with the upper canopy vent holes ghosted and showing one of the inter-canopy suspension structures, according to the first embodiment of the present invention.

As best seen in FIGS. 3 and 7, in order to prevent the perpendicular alignment of upper and lower canopy vent holes 103 104, the upper vent holes 103 are arranged in patterns or groupings 105, such that each upper canopy vent hole group 105 surrounds a corresponding unvented upper canopy section 106, and such that each of the unvented upper canopy sections 106 perpendicularly aligns with one of the lower canopy vent holes 104.

Figure 4:
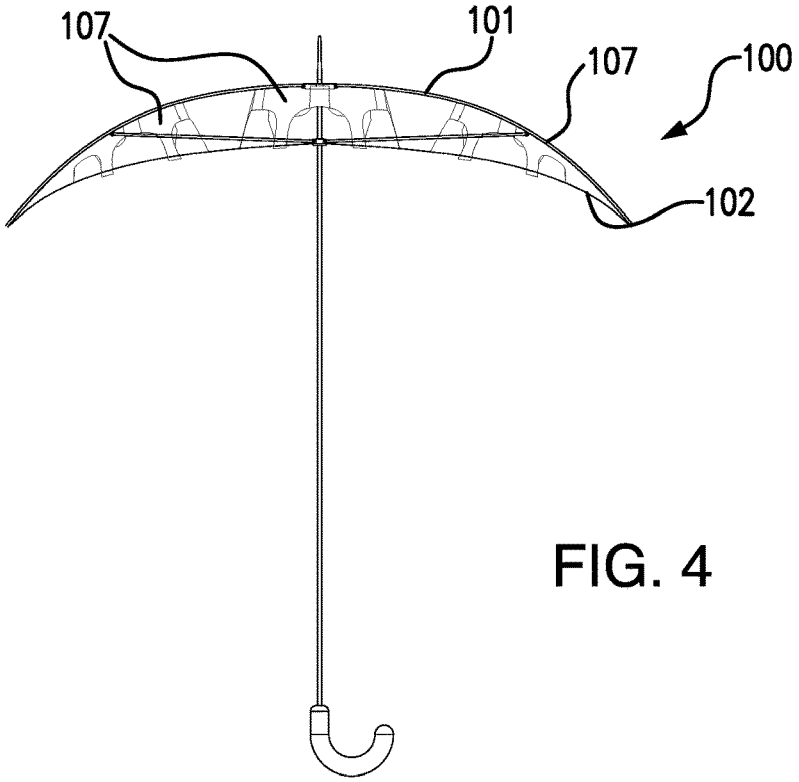
FIG. 4 is a cross-section view of the dual umbrella canopy of FIG. 3, taken along the line 4-4.
Figure 5:
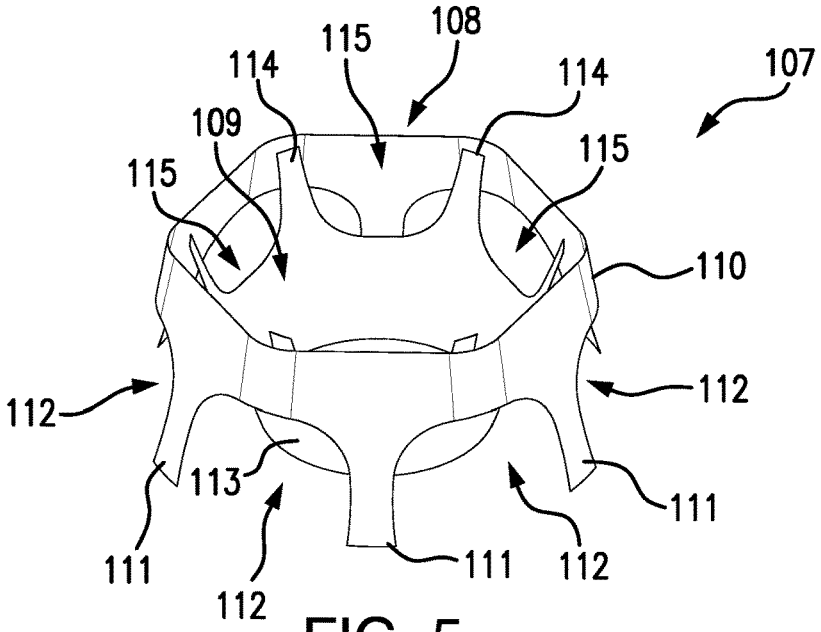
FIG. 5 is a detail perspective upright view of a composite, vented, inter-canopy suspension structure used in the embodiments of the present invention.
Figure 6:
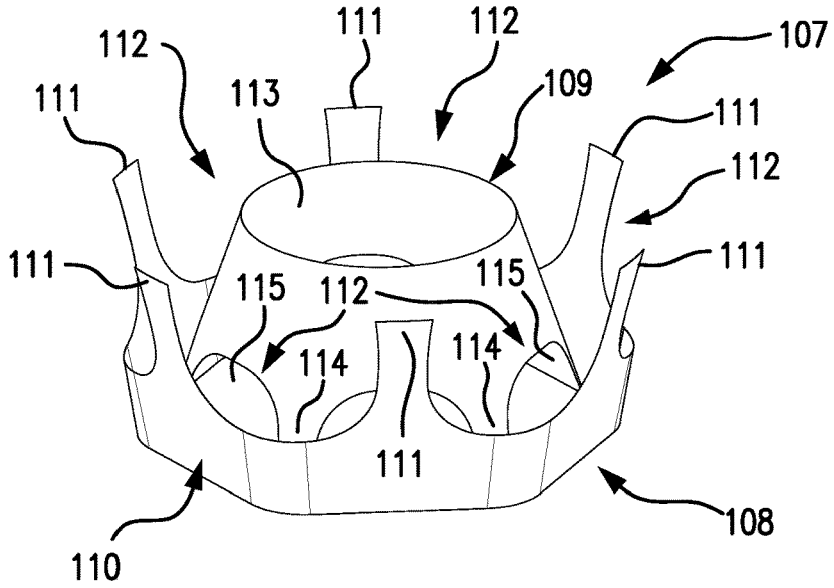
FIG. 6 is a detail perspective inverted view of a composite, vented, inter-canopy suspension structure used in the embodiment of the present invention.

As best seen in FIGS. 4-8, the upper canopy 101 is supported above the lower canopy 102 by multiple inter-canopy suspension structures 107. As best seen in FIGS. 5 and 6, each of the suspension structures 107 is a composite comprising a larger outer suspension element 108, within which is nested a smaller inner suspension element 109, both of which have a coronal shape.

The outer suspension element 108 comprises a tubular or annular-frusto-conical band 110, surmounting multiple, uniformly spaced, tapered outer projections 111, which are separated by multiple, intervening, arcuate-concave, first coronal vent indents 112. The inner suspension element 109 comprises a tubular or annular-frusto-conical base 113, surmounted by multiple, uniformly spaced, tapered inner projections 114, which are separated by multiple, intervening, arcuate-concave, second coronal vent indents 115.

Figure 8:
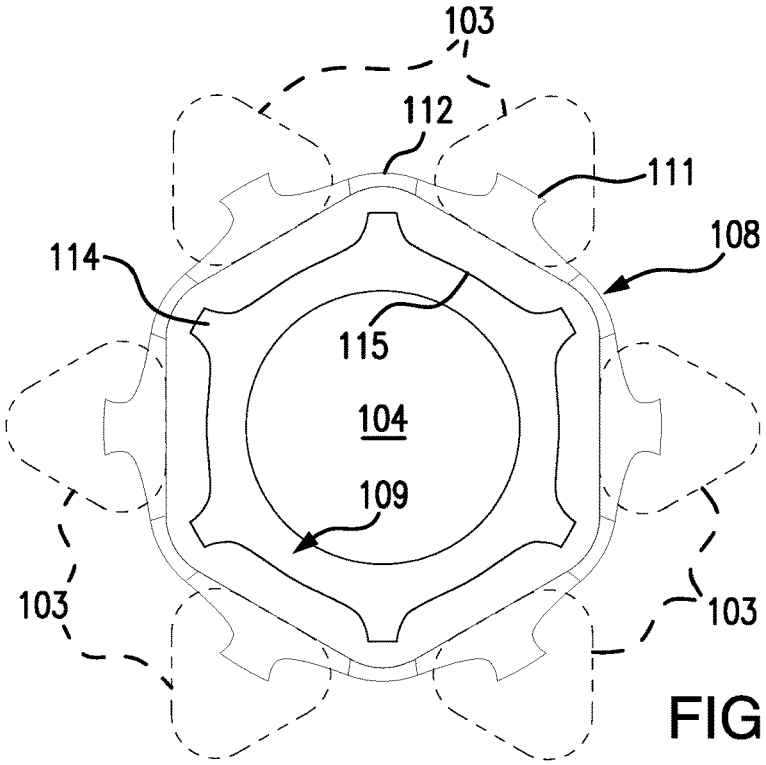
FIG. 8 is a top plan detail view of the inter-canopy by suspension structure depicted in FIG. 7, with upper canopy vent holes ghosted.

As best seen in FIGS. 7 and 8, the inter-canopy suspension structures 107 are configured and arranged so that the base 113 of each of the inner suspension elements 109 surrounds one of the lower canopy vent holes 104, and the band 110 of each of the outer suspension elements 108 engages and supports the unvented upper canopy section 106 with which the surrounded lower canopy vent hole 104 is perpendicularly aligned. As a consequence of this configuration, the band 110 of the outer suspension element 108 and the base 113 of the inner suspension element 109 cooperate to block rain falling through an upper canopy vent hole 103 from entering one of the lower canopy vent holes 104.

As best seen in FIG. 5, the inverted corona of the outer suspension element 108 surrounding the upright corona of the inner suspension element 109 forms multiple paths, through the first coronal vent indents 112 and the second coronal vent indents 115, through which wind can pass into and through the inter-canopy suspension structure 107. This structure thereby allows a downdraft entering the upper canopy vent holes 103 to escape through the lower canopy vent holes 104 via the vented suspension structure 107, and it also conversely allows an updraft entering the lower canopy vent holes 104 to escape through the upper canopy vent holes 103 via the vented suspension structure 107.

In the preferred embodiments, the number of outer projections 111 and inner projections 114—and the corresponding number of first coronal vent indents 112 and second coronal vent indents 115—is determined by the "vent group number," which is the number of upper canopy vent holes 103 comprising an upper canopy vent hole group 105. For example, as best seen in FIGS. 7 and 8, where the upper canopy vent hole group 105 consists of six vent holes, the vent group number is six, which is also the number of outer projections 111, inner projections 114, first coronal vent indents 112, and second coronal vent indents 115 comprising the vented suspension structures 107. Moreover, as best seen in FIG. 7, the shape of the unvented upper canopy sections 106 is a polygon—in this case a hexagon—having a number of sides equal to the vent group number—in this instance six.

Figure 9:
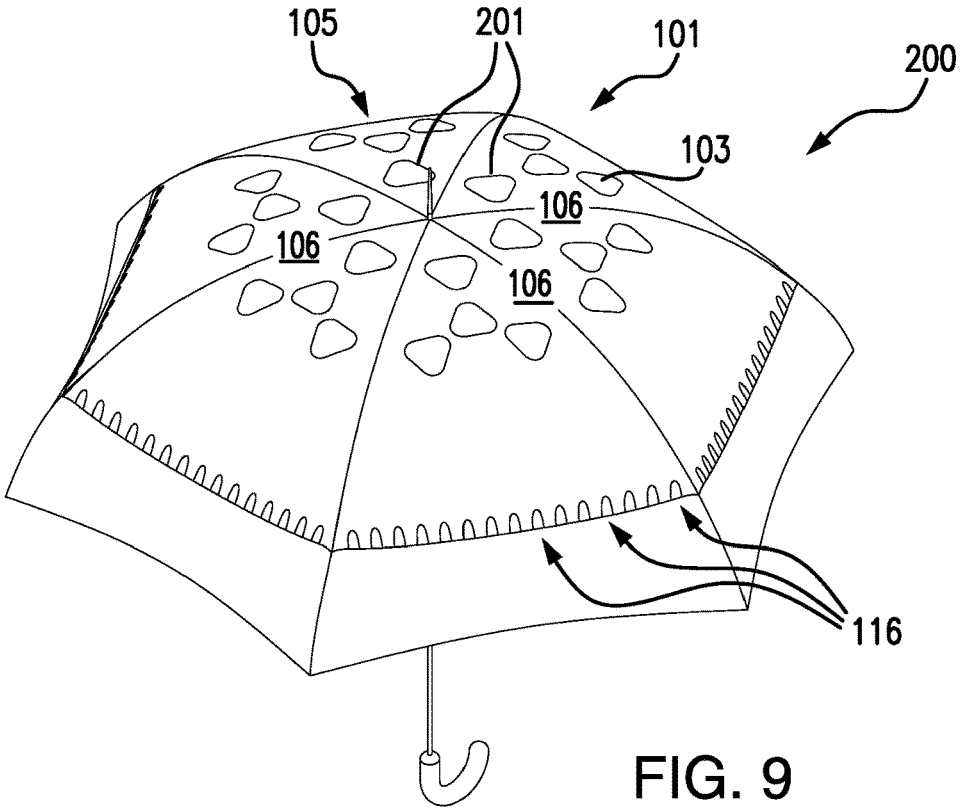
FIG. 9 is a perspective view of a dual umbrella canopy, showing the upper canopy, according to the second embodiment of the present invention.
Figure 10:
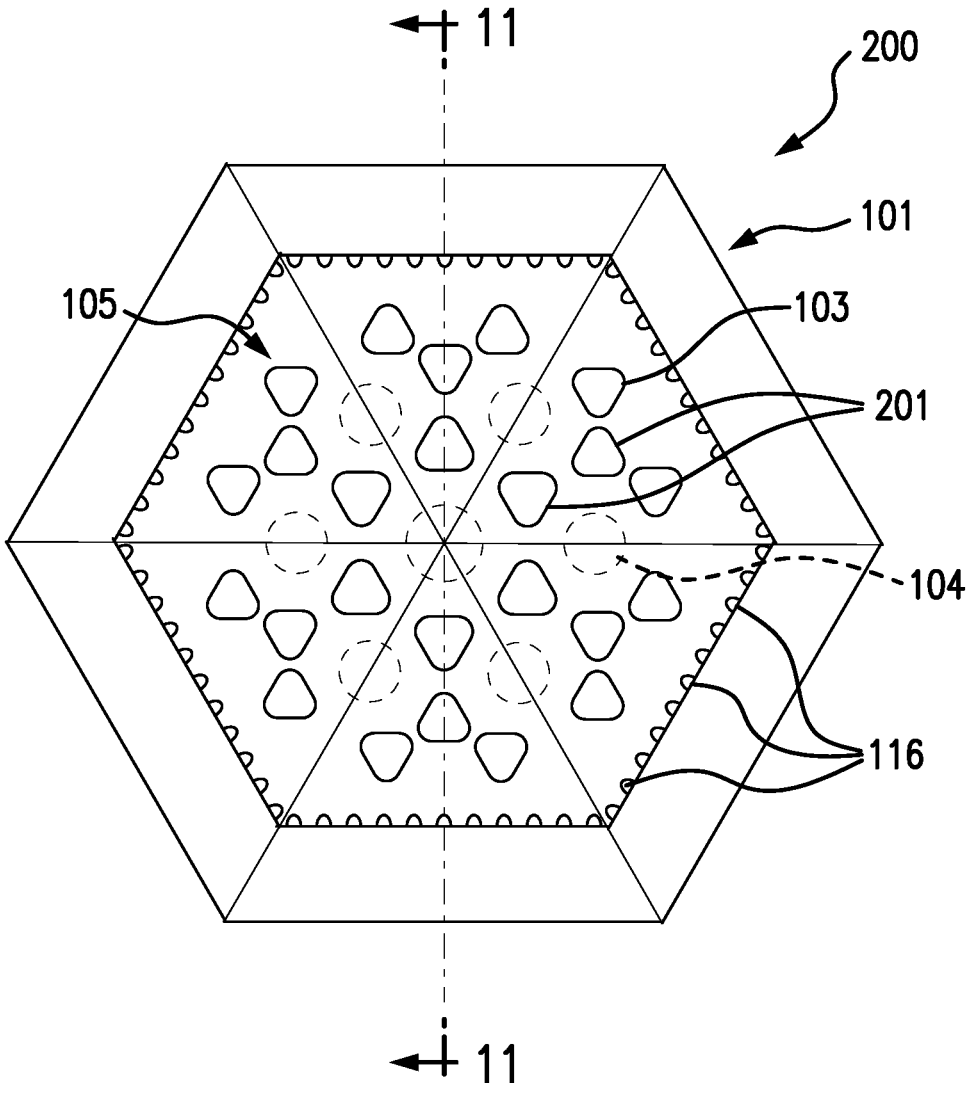
FIG. 10 is a top plan view of the dual umbrella canopy, showing the upper canopy with the lower canopy vent holes ghosted, according to the second embodiment of the present invention.
Figure 11:
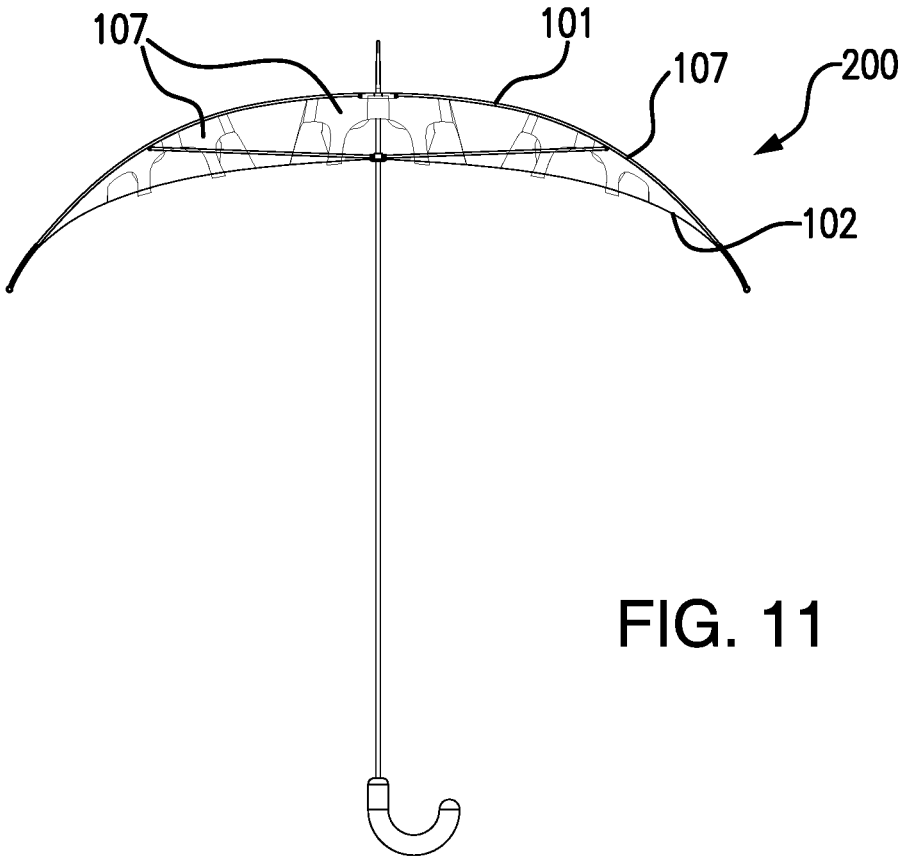
FIG. 11 is a cross-section view of the dual umbrella canopy of FIG. 10, taken along line 11-11.

In the second embodiment of the present invention 200, depicted in FIGS. 9-11, the upper canopy vent hole groups 105 are interlocking, such that some of the upper canopy vent holes 103 are shared holes 201 that belong to more than one vent hole group 105. This configuration 200 enables a greater density of upper canopy vent holes 103 and lower canopy vent holes 104.

As best seen in FIGS. 4 and 11, for the first and second embodiments, the upper canopy 101 and the lower canopy 102 can be sealed together around their respective circumferences, so as to improve the overall strength and stability of the overall dual canopy structure 100. In this configuration, it is necessary to provide for the escape of liquid precipitation that becomes trapped between the two canopies 101 102. This is accomplished by providing a series of drainage outlets 116 around the sealed junction of the two canopies 101 102, as depicted in FIGS. 1-3 and 9-10.

Figure 12:
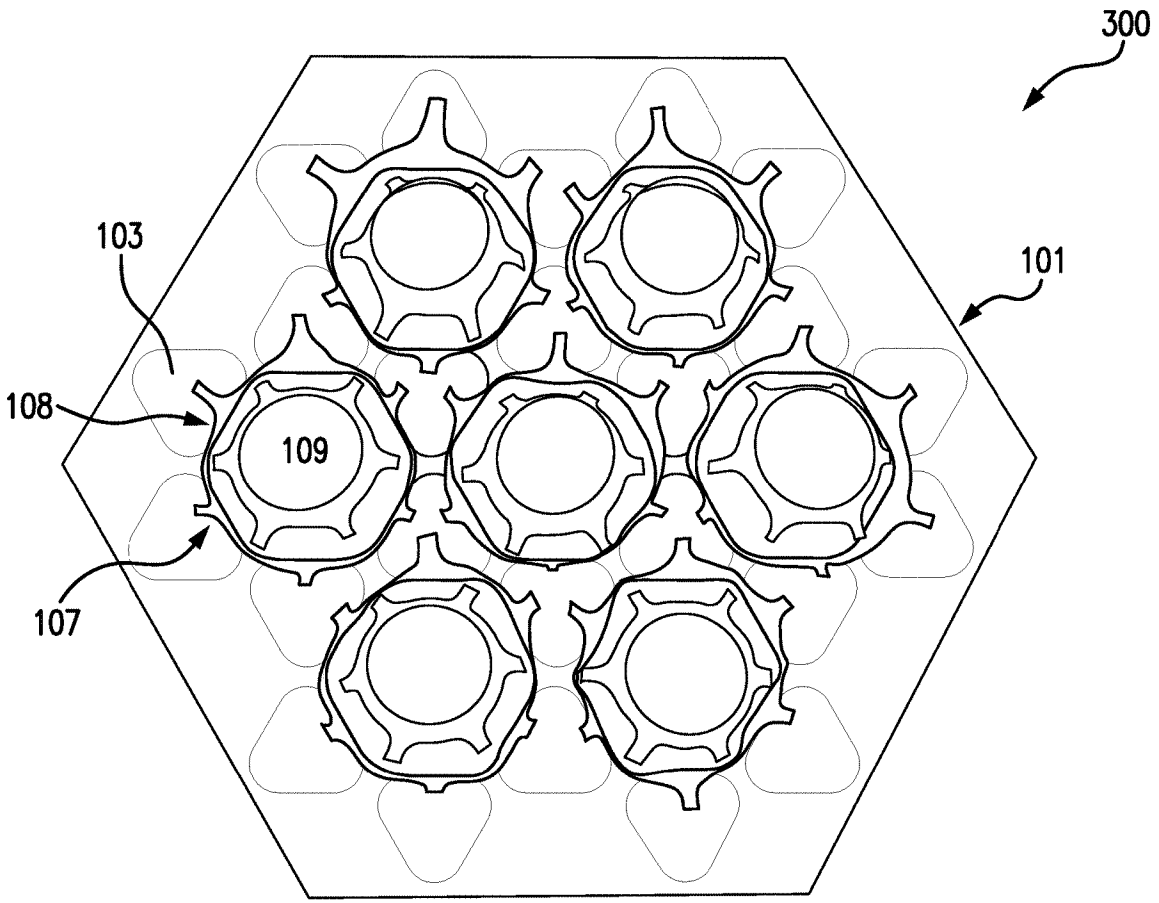
FIG. 12 is a bottom perspective view of a flat upper canopy with inter-canopy suspension structures according to the third embodiment of the present invention.

In the third embodiment of the present invention 300, depicted in FIG. 12, the upper canopy 101 and the lower canopy (not shown) are substantially flat and mutually parallel, so as to form, for example, the fly of a tent. The arrangement of the vent holes 103 and the vented inter-canopy suspension structures 107 is otherwise the same as in the curved umbrella canopy embodiments 100 200.

As used in the claims which follow, the terms "up" and "above" refer to the direction of the upper canopy 101, while the terms "down" and "below" refer to the direction of the lower canopy 102.

Although the preferred embodiments of the present invention have been disclosed for illustrative purposes, those skilled in the art will appreciate that many additions, modifications and substitutions are possible, without departing from the scope and spirit of the present invention as defined by the accompanying claims.

What is claimed is:

1. A wind-proof dual canopy apparatus, comprising:

a lower canopy, having a lower canopy center and a lower canopy circumference, and containing multiple lower canopy vent holes, wherein the lower canopy vent holes are distributed from the lower canopy center to the lower canopy circumference;

an upper canopy, having an upper canopy center and an upper canopy circumference, and containing multiple upper canopy vent holes, wherein the upper canopy vent holes are distributed from the upper canopy center to the upper canopy circumference;

wherein the upper canopy vent holes are arranged in multiple upper canopy vent hole groups, and wherein each upper canopy vent hole group surrounds a corresponding unvented upper canopy section, and wherein each of the unvented upper canopy sections perpendicularly aligns with an aligned lower canopy vent hole;

wherein the upper canopy is connected in spaced relation above the lower canopy by multiple vented suspension structures, and wherein each of the vented suspension structures surrounds one of the lower canopy vent holes and engages the unvented upper canopy section with which the surrounded lower canopy vent hole is aligned;

such that an updraft entering one or more of the lower canopy vent holes passes through the vented suspension structure(s) and escapes through one or more of the upper canopy vent holes, and such that a down draft entering one or more of the upper canopy vent holes passes through the vented suspension structure(s) and escapes through one or more of the lower canopy vent hole(s).

2. The wind-proof dual canopy apparatus according to claim 1, wherein each of the vented suspension structures comprises an outer suspension element and an inner suspension element, and wherein the outer suspension element comprises a tubular or annular frusto-conical band, surmounting multiple, uniformly spaced, tapered outer projections, which are separated by multiple, intervening, arcuate-concave, first coronal vent indents, and wherein the inner suspension element comprises tubular or annular-frusto-conical base, surmounted by multiple, uniformly spaced, tapered inner projections, which are separated by multiple, intervening, arcuate-concave, second coronal vent indents, and wherein the base of the inner suspension element surrounds one of the lower canopy vent holes, and wherein the band of the outer suspension element engages the unvented upper canopy section with which the surrounded lower canopy vent hole is perpendicularly aligned, such that the band of the outer suspension element and the base of the inner suspension element cooperate to block precipitation that falls through one or more of the upper canopy vent holes from passing through one or more of the lower canopy vent holes, and such that the first coronal vent indents and the second coronal vent indents cooperate to allow the downdraft entering one or more of the upper canopy vent hole(s) to escape through one or more of the lower canopy vent hole(s) and to allow the updraft entering one or more of the lower canopy vent hole(s) to escape through one or more of the upper canopy vent hole(s).

3. The wind-proof dual canopy apparatus according to claim 2, wherein each of the upper canopy vent hole groups comprises three or more upper canopy vent holes, which define a vent group number, and wherein each of the unvented upper canopy sections has the shape of a polygon having a number of sides equal to the vent group number.

4. The wind-proof dual canopy apparatus according to claim 3, wherein some or all of the upper canopy vent hole groups are interlocking.

5. The wind-proof dual canopy apparatus according to claim 4, wherein the lower canopy and the upper canopy both have a convex curved configuration so as to form the canopy of an umbrella, and wherein the lower canopy circumference and the upper canopy circumference are sealed together to form a joint canopy circumference, and wherein the joint canopy circumference contain multiple drainage outlets which allow precipitation trapped between the lower canopy and the upper canopy to escape from the dual canopy apparatus.

6. The wind-proof dual canopy apparatus according to claim 3, wherein the lower canopy and the upper canopy both have a convex curved configuration so as to form the canopy of an umbrella, and wherein the lower canopy circumference and the upper canopy circumference are sealed together to form a joint canopy circumference, and wherein the joint canopy circumference contain a multiple drainage outlets which allow precipitation trapped between the lower canopy and the upper canopy to escape from the dual canopy apparatus.

7. The wind-proof dual canopy apparatus according to claim 3, wherein the inner suspension element has a number of second coronal vent indents equal to the vent group number.

8. The wind-proof dual canopy apparatus according to claim 7, wherein some or all of the upper canopy vent hole groups are interlocking.

9. The wind-proof dual canopy apparatus according to claim 8, wherein the lower canopy and the upper canopy both have a convex curved configuration so as to form the canopy of an umbrella, and wherein the lower canopy circumference and the upper canopy circumference are sealed together to form a joint canopy circumference, and wherein the joint canopy circumference contain multiple drainage outlets which allow precipitation trapped between the lower canopy and the upper canopy to escape from the dual canopy apparatus.

10. The wind-proof dual canopy apparatus according to claim 7, wherein the lower canopy and the upper canopy both have a convex curved configuration so as to form the canopy of an umbrella, and wherein the lower canopy circumference and the upper canopy circumference are sealed together to form a joint canopy circumference, and wherein the joint canopy circumference contain multiple drainage outlets which allow precipitation trapped between the lower canopy and the upper canopy to escape from the dual canopy apparatus.

11. The wind-proof dual canopy apparatus according to claim 7, wherein the outer suspension elements has a number of first coronal vent indents equal to the vent group number.

12. The wind-proof dual canopy apparatus according to claim 11, wherein some or all of the upper canopy vent hole groups are interlocking.

13. The wind-proof dual canopy apparatus according to claim 12, wherein the lower canopy and the upper canopy both have a convex curved configuration so as to form the canopy of an umbrella, and wherein the lower canopy circumference and the upper canopy circumference are sealed together to form a joint canopy circumference, and wherein the joint canopy circumference contain multiple drainage outlets which allow precipitation trapped between the lower canopy and the upper canopy to escape from the dual canopy apparatus.

14. The wind-proof dual canopy apparatus according to claim 11, wherein the lower canopy and the upper canopy both have a convex curved configuration so as to form the canopy of an umbrella, and wherein the lower canopy circumference and the upper canopy circumference are sealed together to form a joint canopy circumference, and wherein the joint canopy circumference contain multiple drainage outlets which allow precipitation trapped between the lower canopy and the upper canopy to escape from the dual canopy apparatus.

15. The wind-proof dual canopy apparatus according to claim 11, wherein the vent group number is six, and wherein the outer canopy suspension elements comprises an upwardly-tapering annular-frusto-conical band surmounting six downwardly tapering first coronal projections in hexagonally spaced relation with six intervening first coronal vent indents, and wherein the inner canopy suspension element comprises a downwardly tapering annular-frusto-conical base surmounted by six upwardly tapering second coronal projections in hexagonally spaced relation with six intervening second coronal vent indents.

16. The wind-proof dual canopy apparatus according to claim 15, wherein some or all of the upper canopy vent hole groups are interlocking.

17. The wind-proof dual canopy apparatus according to claim 16, wherein the lower canopy and the upper canopy both have a convex curved configuration so as to form the canopy of an umbrella, and wherein the lower canopy circumference and the upper canopy circumference are sealed together to form a joint canopy circumference, and wherein the joint canopy circumference contain multiple drainage outlets which allow precipitation trapped between the lower canopy and the upper canopy to escape from the dual canopy apparatus.

18. The wind-proof dual canopy apparatus according to claim 15, wherein the lower canopy and the upper canopy both have a convex curved configuration so as to form the canopy of an umbrella, and wherein the lower canopy circumference and the upper canopy circumference are sealed together to form a joint canopy circumference, and wherein the joint canopy circumference contain multiple drainage outlets which allow precipitation trapped between the lower canopy and the upper canopy to escape from the dual canopy apparatus.

* * * * *